United States Patent [19]

Hastings

[11] 4,110,869

[45] Sep. 5, 1978

[54] HANDLEBAR LATCHING MECHANISM FOR LAWN AND YARD IMPLEMENT

[76] Inventor: Paul F. Hastings, N. 5509 Market St., Spokane, Wash. 99207

[21] Appl. No.: 842,408

[22] Filed: Oct. 17, 1977

Related U.S. Application Data

[62] Division of Ser. No. 716,132, Aug. 8, 1976.

[51] Int. Cl.[2] ..... B62B 3/02; B62B 5/06

[52] U.S. Cl. ..... 16/111 A; 56/DIG. 18; 280/47.37 R; 403/102; 403/393

[58] Field of Search ..... 16/111 A, 111 R, 112; 280/47.37 R; 56/DIG. 18; 403/393, 354, 102

[56] References Cited

U.S. PATENT DOCUMENTS

| | | | |
|---|---|---|---|
| 1,719,791 | 7/1929 | Wolf | 56/DIG. 18 |
| 2,539,087 | 1/1951 | Kramer | 16/111 A |
| 2,556,839 | 6/1951 | Cretella | 403/393 |
| 3,680,448 | 8/1972 | Ballingall et al. | 403/102 X |
| 3,694,855 | 10/1972 | Meyer et al. | 16/111 A |

*Primary Examiner*—James Kee Chi

*Attorney, Agent, or Firm*—Wells, St. John & Roberts

[57] ABSTRACT

A latching mechanism is described for removably mounting a handlebar to a lawn and yard implement. Also described is a powered lawn and yard implement for removing trash or like material from a lawn or yard and discharging the material into a wheeled pushcart. The implement includes a wheel supported housing to which the wheeled pushcart is releasably connected. A chute assembly directs trash from the housing into an upwardly open bin of the pushcart. The pushcart includes an elongated support roller and a pushbar assembly that facilitate independent movement of the pushcart assembly when detached from the housing. The housing includes a latching mechanism that may be operated from one side of the housing to secure or release the pushcart relative to the housing. Also associated with the latching mechanism is a deflector assembly that operates in response to operation of the latching assembly to open or close the discharge chute leading to the open bin. When the pushcart is detached from the housing, the deflector mechanism is located in position to prevent discharge of material through the chute. When the cart is attached to the housing, the latch mechanism and associated deflector mechanism are moved to positions wherein the latch mechanism releasably locks the pushcart to the housing and the deflector mechanism opens to become an integral part of the chute means, guiding discharged trash into the attached cart.

10 Claims, 11 Drawing Figures

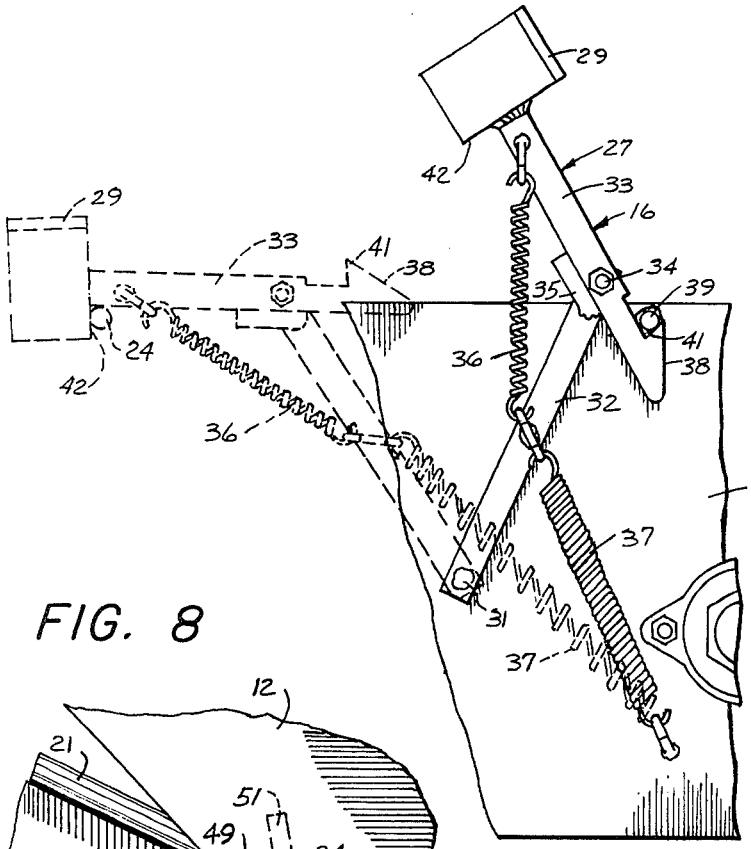
FIG. 6
FIG. 8
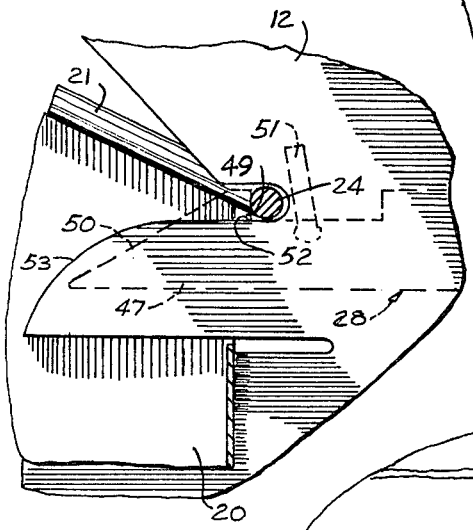
FIG. 7
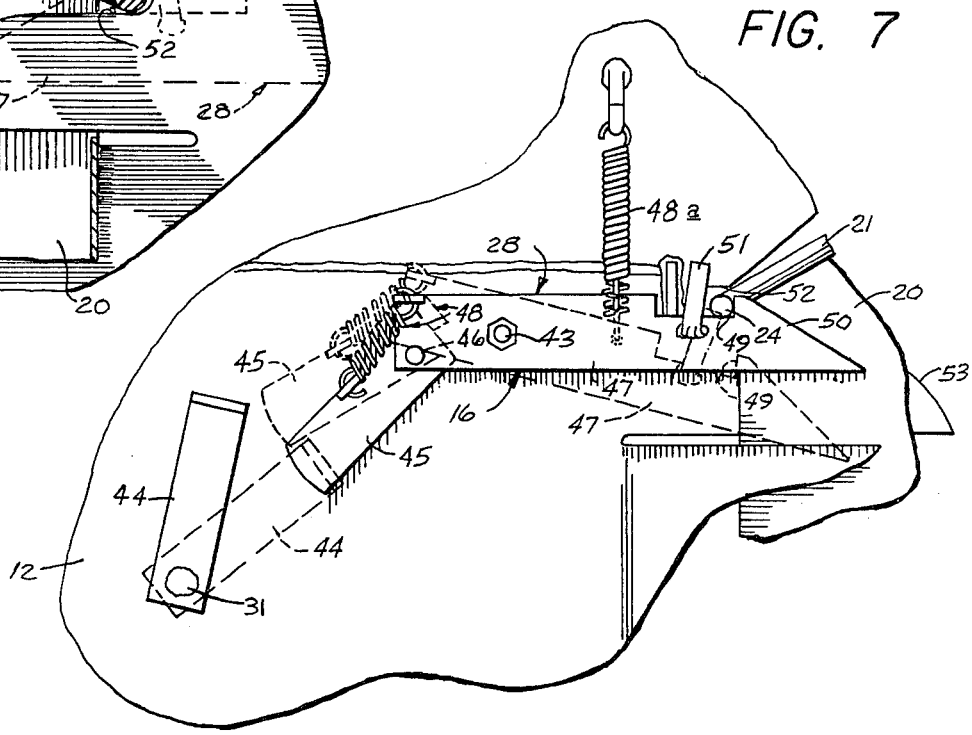

FIG. 9
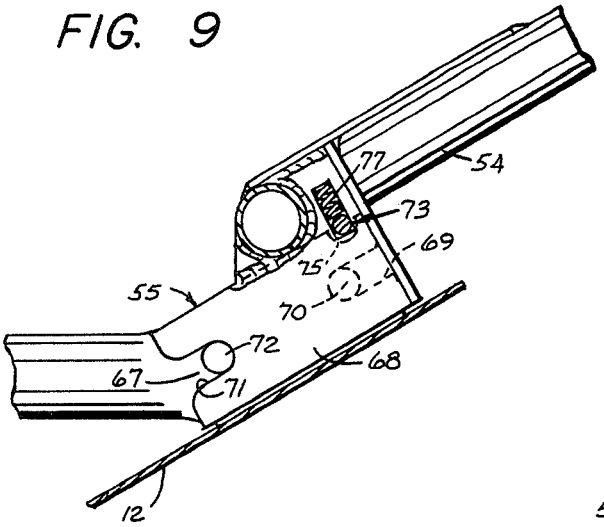
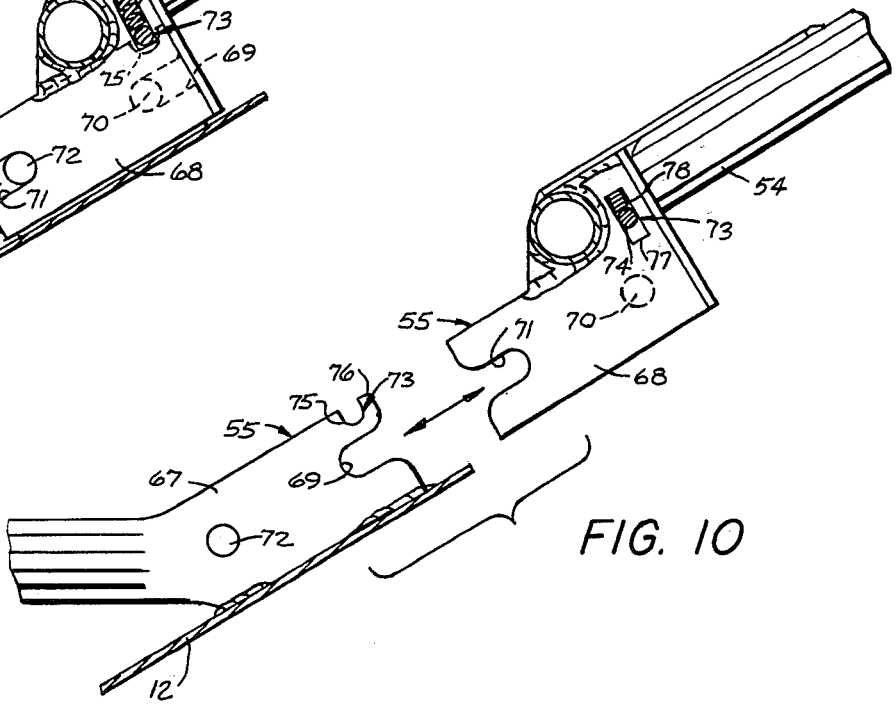
FIG. 10
FIG. 11
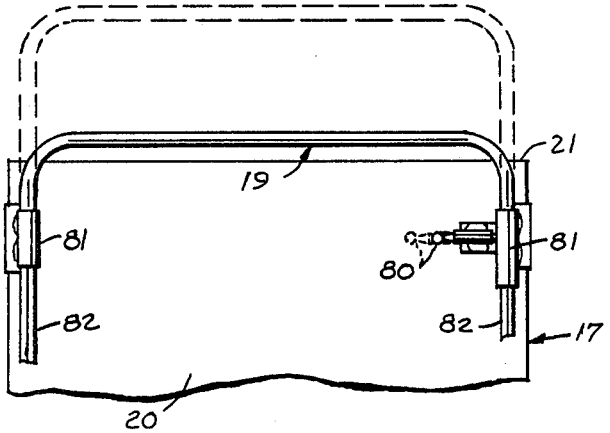

HANDLEBAR LATCHING MECHANISM FOR LAWN AND YARD IMPLEMENT

This is a division of my co-pending application, Ser. No. 716,132, filed Aug. 8, 1976 entitled Lawn and Yard Implement.

BACKGROUND OF THE INVENTION

The present invention relates generally to the field of latching mechanisms and more particularly to such mechanisms used for attaching handlebars to lawn and yard implements.

Lawn and yard implements such as that disclosed in my co-pending parent application, Ser. No. 716,132, and other such implements, are often too bulky for storage unless some mechanism is available by which the handlebar may be removed and stored separately. The problem, however, is obtaining such a mechanism that is sturdy and reliable. The vibration from powered implements often works prior forms of latching mechanisms loose. Further, substantial forces may be applied through a handlebar, requiring that the associated latching mechanism be capable of handling the forces while remaining securely latched.

BRIEF DESCRIPTION OF THE DRAWINGS

FIG. 6 is an enlarged fragmentary view illustrating operation of the present latching mechanism;

FIG. 7 is a view showing the latching mechanism on the opposite side of the implement housing;

FIG. 8 is an enlarged fragmentary detail view;

FIG. 9 is a fragmentary view of my handlebar latching mechanism;

FIG. 10 is a view similar to FIG. 9 only showing the elements thereof in a separated condition; and FIG. 11 is a fragmentary end view showing different operational positions of the pushcart pushbar assembly.

DETAILED DESCRIPTION OF A PREFERRED EMBODIMENT

Figure 1:
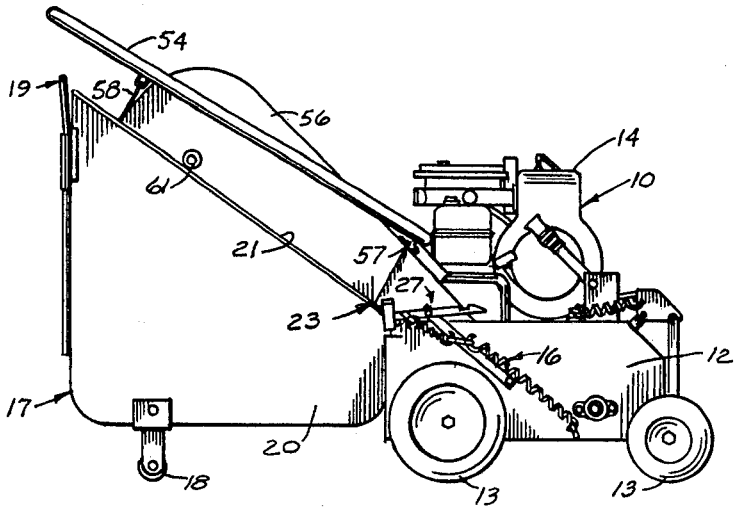
FIG. 1 is a side elevational view of the present implement.

The present implement is generally illustrated in the accompanying drawings and is designated therein by the reference character 10. The present implement 10 utilizes a powered ground working means 11 (FIG. 4) for removing trash or like material from or adjacent to the ground surface. The term "trash" as used herein is to be taken as meaning material such as rooted dead grass, leaves, garbage, or other debris lying on or adjacent to the ground surface. Further, the ground working means 11, although shown as a "power rake" or lawn renovator, may take the form of other ground working assemblies such as a power vacuum, power sweeper, power mower, etc.

The ground working means 11 is operatively mounted within a downwardly open housing 12. Housing 12 is movably supported above the ground surface by a number of freely rotatable wheels 13. An engine 14 is mounted to housing 12 to provide driving force to the ground working means 11. It is also contemplated that the engine 14 could also be utilized to provide driving power to one or more of the wheels 13 in order to assist forward or rearward movement of the housing along the ground surface.

Figure 2:
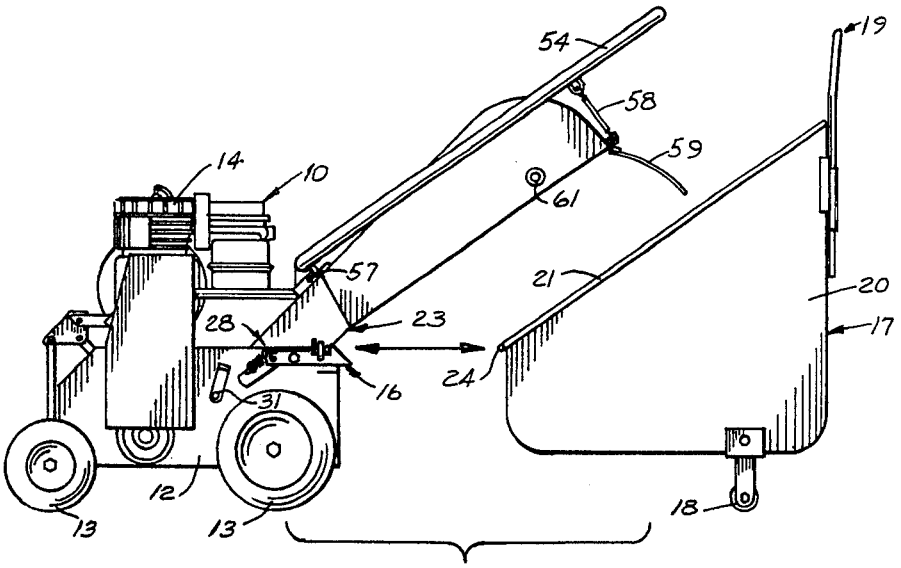
FIG. 2 is an opposite side elevational view showing the pushcart removed from the remainder of the implement assembly.
Figure 3:
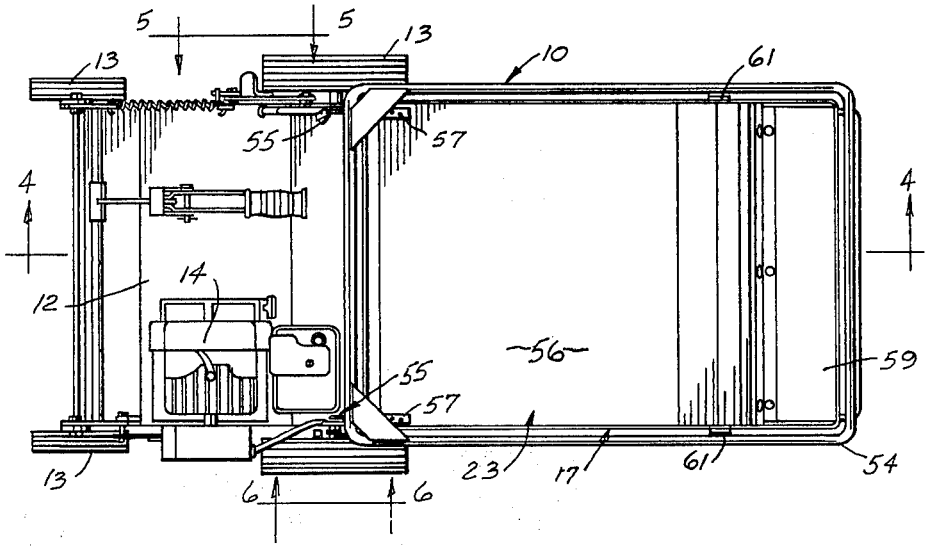
FIG. 3 is a plan view of the complete implement.
Figure 5:
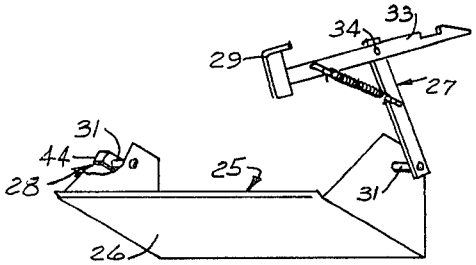
FIG 5 is an isolated pictorial view of a portion of my invention.

A latching means is provided as generally shown at 16 to releasably fix a pushcart 17 to the housing 12. The pushcart 17 is movably supported on the ground surface by an elongated roller 18. An extensible pushbar 19 is provided at a rearward end of the pushcart 17. The pushcart assembly as shown alone in FIG. 2, is fully capable of being moved about along the ground surface independently of the remaining implement 10. The pushcart is basically similar to ordinary pushcarts presently utilized for gardening purposes. It includes an upwardly open bin 20 with the opening thereof defined by a peripheral bin edge 21.

The implement includes a chute means generally shown at 23 for directing material outward of the housing 12 and into the bin 20. A portion of the chute means is detachable from the housing to facilitate storage and transport of the entire implement.

Figure 4:
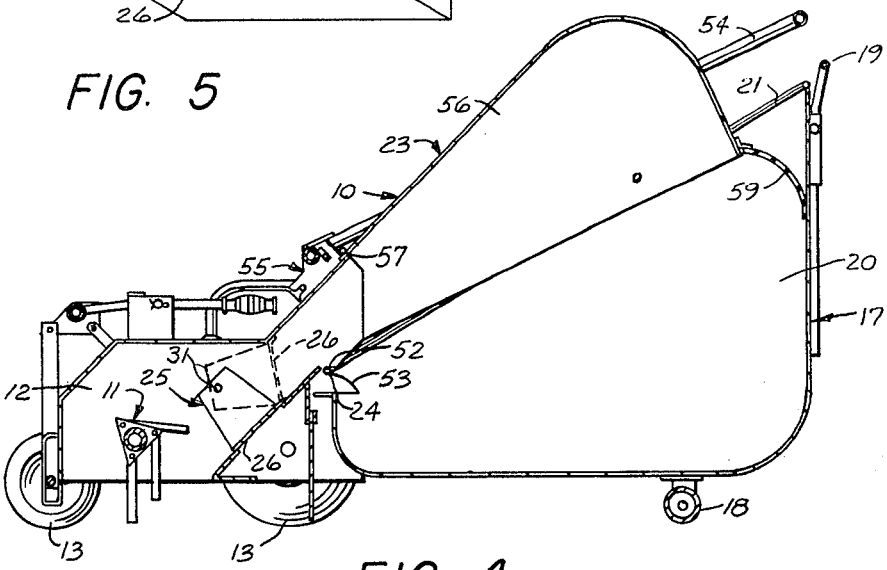
FIG. 4 is a sectional view taken along line 4—4 in FIG. 3.

A deflector means 25 is provided within the housing 12 and is directly associated with the latching mechanism 16 to close the chute means 23 when the pushcart is in a detached condition as shown in FIG. 2. The deflector means 25 may also be opened to the position shown in solid lines in FIG. 4 to allow passage of trash from the housing and into the attached pushcart 17. Deflector means 25 is comprised of a pivoted plate 26 as shown in FIGS. 4 and 8.

The latching means 16 is shown in substantial detail in FIGS. 1, 2, 6 and 7. Latching means 16 is comprised of catch mechanisms 27 and 28 located on opposite sides of the housing 12. Mechanisms 27 and 28 operate in unison upon a transverse locking member 24 on a forward edge of the bin 20. A release means is provided in the form of a handle 29 on the catch mechanism 27 that may be operated from one side of the implement to move both mechanisms 27 and 28 between a locking and releasing position.

Both mechanisms 27 and 28 are interconnected across the width of housing 12 through the plate 26. Coaxial rods 31 rigidly mount the mechanisms to the deflector plate 26 for movement therewith. Thus, pivotal movement of one mechanism 27 or 28 will cause corresponding movement of the plate 26 and other mechanisms.

The catch mechanism 27 is shown in particular detail by FIG. 6 of the drawings. It is comprised of an elongated arm 32 fixed rigidly to one of the rods 31. Arm 32 extends radially from a rod 31 to an outer end that pivotably mounts a latch arm 33 at a pivot 34. An angular stop 35 is fixed to arm 32 to prevent pivotal movement of the latch arm 33 past a prescribed angle. However, the latch arm 33 may pivot in the opposite direction against the resistance offered by a spring 36 extending between arm 33 and arm 32. Another spring 37 extends between arm 32 and the housing 12 to urge the complete catch mechanism 27 forwardly toward the front set of wheels 13. The spring 37 offers resistance to pivotal movement of the assembly about the axis of connector rod 30 between the positions shown in solid and dashed lines in FIG. 6.

Latch arm 33 includes an angular cam surface 38 leading to an integral catch surface 41. This surface is engageable with a pin 39 that is affixed to housing 12. The relative position of the catch mechanism 27 when engaged with pin 39 is shown in solid lines in FIG. 6. Pin 39 and catch surface 41 comprise a deflector lock means which is operative to lock deflector plate 26 in the closed position (dotted lines, FIG. 4) when the pushcart is detached from the housing.

An additional catch or hook surface 42 is provided at an opposite end of the latch arm 33. It is selectively engageable with the locking member 24 of the pushcart 17. Thus, it may be understood that when the catch mechanism 27 is in the position shown by dotted lines in FIG. 6, one side of the pushcart is substantially locked in relation to the housing 12 by the catch surface 42.

On the side of housing 12 opposite catch mechanism 27 is the other catch mechanism 28. Catch mechanism 28 is operative in response to pivotal movement of mechanism 27 and plate 26 to selectively lock the opposite side of the pushcart in place on the housing 12. Mechanism 28 includes a trip arm 44 that is rigidly mounted to a rod 31. Trip arm 44, upon pivotal movement of plate 26 and assembly 27 works against a flipper 45 that is mounted at a pivot 46 to a catch arm 47. The catch arm 47 is mounted at a pivot 43 to the housing 12. A spring and stop assembly 48 operatively engage the flipper 45 from the catch arm 47 to resist pivotal movement of the flipper 45 in a counter-clockwise direction. The spring and stop assembly also prevents flipper movement in a clockwise direction as viewed in FIG. 7. Thus, the trip arm 44 may move downwardly past the flipper 45 to become situated underneath in the relationship shown by dashed lines in FIG. 7.

The catch arm 47 is normally held in an upwardly locking position (solid lines, FIG. 7) by a spring 48*a*. A catch surface 49 is provided at a rearward end of the catch arm 47 to receive and releasably hold the locking member 24 of pushcart 17. An inclined cam surface 50 is provided rearward of the slot 49 to facilitate connection of the pushcart and housing. A pusher arm 51 is rigidly fixed to the catch arm 47 adjacent catch 49. Pusher arm 51 operates against the locking member 24 to push it rearwardly away from engagement with the housing as the arm 47 is pivoted toward the release position as shown by the dashed lines in FIG. 7.

An opposed pair of horizontal slots 52 is provided in housing 12 directly adjacent the catch mechanisms 27 and 28. The horizontal slots 52 (FIG. 8) slidably receive the locking member 24 of pushcart 17. It is the purpose of slots 52 to prevent vertical movement of the locking member relative to housing 12. The respective catch mechanisms 27 and 28 selectively prevent rearward horizontal movement of the locking member. Thus, the slots 52 operate in conjunction with the remainder of the latching means 16 to selectively fix the pushcart relative to the housing 12. However, the pushcart remains in a pivotable relationship wherein the cart 17 and housing 12 may pivot independently of one another about the axis of the locking member 24.

Arcuate cam surfaces 53 are provided on opposite sides of the housing 12 to guide movement of the locking member upwardly into engagement with the respective slots 52. As shown in FIG. 8, the cam surfaces 53 fit within open slots formed through the bin 20 at opposite front corners.

The chute means 23 is shown in detail by FIGS. 1 through 4. Parts of means 23 are integral with the housing 12 and constitute a discharge opening for rearwardly projected trash. The remainder of means 23 is mounted to a handlebar assemby 54. Handlebar assembly is releasably connected to the housing 12 through a handlebar latching means 55.

Chute means 23, in conjunction with elements of the housing 12, includes a removable shroud 56 that is suspended from the handlebar assembly 54. Shroud 56 is mounted by hinges 57 to assembly 54 at a forward edge thereof. Cords 58 loosely connect the rearward end of shroud 56 to assembly 54 adjacent a rearward end thereof. A rubber flap 59 is fixed to the rearward end of shroud 56 and depends therefrom into the confines of the pushcart bin 20 (FIG. 4). The rubber flap 59 allows relative movement of the bin 20 and shroud 56 but prevents escape of material from between the shroud and bin.

A pair of rollers 61 are rotatably mounted to the shroud 56 and engage the peripheral edge 21 of bin 20 as shown in FIG. 1. The rollers 61 provide support to the shroud 56 through engagement with the bin when the pushcart is locked to the housing 12. When the pushcart is removed from the housing, the shroud is supported through the cords 58 and handlebar assembly 54. Rollers 61 will move freely over the surface of edges 21 to facilitate mounting and dismounting of the pushcart to the housing and enable relative pivotal movement between the pushcart and housing while remaining in contact therewith to guide passage of trash from the housing into the bin 20.

The handlebar latching means 55 is shown in substantial detail in FIGS. 9 and 10. As shown, means 55 includes a first pair of brackets 67 that are affixed to the housing 12. A second pair of brackets 68 are also provided to releasably engage the first pair 67. Brackets 68 are fixed at forward ends of the handlebar assembly 54. The first pair of brackets 67 include rearwardly open slots 69. Slots 69 slidably receive pins 70 that are affixed to the complementary brackets 68. Similarly, the brackets 68 include forwardly open slots 71. Slots 71 are parallel to slots 69 and receive pins 72 that are rigidly fixed to brackets 67. The interfitting relationship of the bracket pairs is shown by FIG. 9. Separation of the respective brackets is shown in FIG. 10.

A detent means 73 is provided to releasably secure the brackets in the position shown in FIG. 9. Detent means 73 is simply comprised of an elongated rod 74 extending between the brackets 68. Rod 74 is received within upwardly open indentations 75 of brackets 67. A rounded cam surface 76 is provided on each bracket 67 to lead the rod 74 into the associated indentation 75.

The rod 74 is mounted for sliding movement within closed slots 77. Slots 77 are oriented substantially perpendicular to the slots 69 and 71. Thus, the rod 74 may be selectively moved within the slots to engage or disengage the complementary indentations 75.

Ordinarily, the weight of the rod 74 is sufficient to hold it in place within the indentations 75. However, to assure that vibration of the engine 14 or ground working means 11 does not disengage rod 74 from indentations 75, a spring member 78 may be provided adjacent either end of the rod 74. Such a spring may be connected between the rod 74 and handlebar assembly 54 to force the rod toward the downward position as shown in FIG. 9. The spring will give way under pressure exerted by an operator's hand to move upwardly and become disengaged from the indentations 75 to thereby allow release of the interconnected brackets. When connected, the brackets and detent means provide an extemely secure, locked connection between the handlebar assembly 54 and housing 12. The handlebar assembly may thus transfer forces in substantially any direction directly to the housing 12 and wheels 13.

FIG. 11 shows an adjustment feature of the pushbar assembly 19 of cart 17. As shown, the pushbar 19 includes downwardly projecting legs 82 that are slidably received within complementary sleeves 81. Sleeves 81 are rigidly affixed to the pushcart bin 20. A snap pin 80 is provided on one side and engages through one of the sleeves 81 to fit within a selected aperture (not shown) of several spaced along the associated pushbar leg. The snap pin 80 is spring loaded and urged toward a locked position. To move the pushbar to the operative position (dashed lines FIG. 11), the user simply pulls the snap pin 80 outwardly to the dashed line position and simultaneously lifts upwardly against the pushbar 19. The legs 82 will slide through sleeves 81 until the appropriate aperture comes into alignment with snap pin 80. At this point, the pin 80 is released to be received within the selected aperture, locking the pushbar in the selected elevational position. Downward adjustment of the pushbar is accomplished similarly.

A detailed description of the operation of the present invention may now be easily understood from the foregoing description of the elements associated therewith. Before entering into the operational description however, an assumption will be made that the implement elements are in an unassembled condition (i.e., the housing is detached from the handlebar assembly and pushcart). Thus, the operational description will begin with the steps taken to assemble the implement to the condition shown in FIG. 1.

An initial step in assembling the present implement may be to attach the handlebar assembly 54 and associated elements to the housing 12. This is done simply by grasping the handlebar assembly and moving the second pair of brackets 68 into engagement with the first pair 67 on housing 12. In doing this, the pins 70 slide into engagement with slots 69 and pins 72 similarly slide into engagement with slots 71. Also, the rod 74 is moved by the rounded cam surface 76 to lift upwardly and finally snap downwardly into engagement with the complementary indentations 75 in brackets 67. This locks the handlebar assembly rigidly to the housing 12. No particular arrangement need be utilized to assure engagement of the shroud 56 with the complementary portions of the chute means 23 on housing 12. It simply rests against the chute portion of housing 12 in a slidable engagement therewith. The implement has now attained the configuration as shown in FIG. 2 with the pushcart detached therefrom.

The next step is then to attach the pushcart to the housing 12. This is done simply by moving the forward edge of the pushcart toward the latching means 16, bringing the locking member 24 against the cam surfaces 53 on housing 12. These surfaces 53 guide the locking member upward and forwardly into engagement with the horizontal slots 52. During this time, the catch mechanism 27 is located in the position shown by solid lines in FIG. 6 with the deflector plate 26 correspondingly located in the closed position. The locking member 24 is free to become slidably engaged with the slot 52 on that side of the housing. On the opposite side of the housing, the locking member will slide against the cam surface of catch mechanism 28 and snap into engagement with the catch surface 49. Thus, this movement locks one side of the pushcart automatically upon reception thereof within the slots 52.

Once the lock member is in place within the slots 52, the catch mechanism 27 may be operated to bring the catch surface 42 into engagemet with the lock member 24. In doing this, the user first lifts upwardly on the release handle 29 to disengage the catch surface 41 from pin 39. He then pivots the arms 32 and 33 to move the catch surface away from pin 39 and enable pivotal movement of the arm 32 to the position shown in dashed lines. This brings the catch 42 into engagement with the lock member 24. This movement of catch mechanism 27 causes corresponding movement of the plate 26 to the open position (solid lines FIG. 4). Also, the trip arm 44 simultaneously moves downwardly past the flipper 45 to its dotted line position as shown in FIG. 7 (the catch mechanism remains in the locking solid line position).

It may be noted that this entire procedure to this point may be performed from one side of the machine. This is a distinct advantage in that the operator need not move back and forth from one side of the machine to the other in order to interconnect the housing 12 and bin 20 as is required on some existing equipment with regard to a catcher bag or related assembly. The assembly configuration of the implement is best illustrated by FIG. 1 of the drawings.

During use, the engine 14 is started and the ground working means 11 becomes operative to lift and disengage trash from the ground surface and project it rearwardly through the chute means 23 and into the cart bin 20. The shroud 56 prevents material being discharged through the chute 23 from striking the operator as he pushes the implement by the handlebar 54.

The pushcart 17 is supported through the roller 18 and rides along the ground surface along with the housing 12. The pushcart may pivot about the axis of lock member 24 in response to changes in terrain along the ground surface. The resulting articulating movement between pushcart 17 and housing 12 is accommodated by the hinges 57 and rollers 61 of the shroud 56 such that constant contact is made between the shroud and pushcart to prevent discharge of material against the operator. The rubber flap 59 also assists in this function by sliding up and down against the rearward wall of bin 20.

Continued operation of the implement will result in filling of the pushcart bin with trash. At this point, the pushcart may be removed from the housing 12 and pushed or pulled to a distant location utilizing the roller 18 as support and by pushing or pulling against the pushbar 19.

To disconnect the housing 12 and pushcart 17, the user simply moves to one side of the implement and lifts the release handle 29 of mechanism 27 upwardly to bring the catch surface 42 upwardly from engagement with the locking member 24. The deflector plate 26 will simultaneously move from the open position as shown in solid lines in FIG. 4 to the closed position as shown in dashed lines. This prevents discharge of material through the chute means 23 when the cart is detached from the housing.

Also, the trip arm 44 will move upwardly against the flipper 45. However, upward pivotal movement of the flipper 45 is prevented by the spring and stop assembly 48, so the only resultant movement can be pivotal movement of the catch arm 47 to the release position (dashed lines, FIG. 7). In moving to this position, the locking member 24 is disengaged from the catch surface 49 and pusher arm 51 acts against the lock member 24 to push it rearwardly from engagement with the associated slot 52. This movement then completely disengages the pushcart from the housing 12.

The handlebar assembly of pushcart 17 may be selectively adjusted up or down as previously described to facilitate handling of the pushcart and to enable it to be pushed or pulled to a selected location in order to facilitate dumping of the trash from the bin 20. The emptied cart is then moved back to the housing and attached in the manner previously described to facilitate continued use.

It may have become evident from the above description and attached drawings that various changes and modifications may be made therein. However, many such changes and modifications are intended to be included within the scope of this invention. Therefore, only the following claims are to be taken as restrictions upon the scope of my invention.

What I claim is:

1. A handlebar latching mechanism for releasably attaching a handlebar to a lawn and yarn implement, comprising:

a first pair of slotted brackets adapted to be fixed to the implement;

a second pair of slotted brackets adpated to be fixed to the handlebar;

wherein the first and second slotted brackets mate in a releasable interlocking relationship;

wherein each bracket of one pair includes a pin projecting therefrom to be slidably received by a matching slot of a mating bracket of the opposed pair; and selectively releasable detent means for locking the mating brackets together.

2. The handlebar latching mechanism as set out in claim 1 wherein the detent means comprises:

a matching pair of closed slots in the second pair of brackets; said closed slots being substantially perpendicular to the remaining bracket slots of the first and second bracket pairs;

an elongated rod extending between the brackets of the second pair and being received within the matching pair of closed slots for movement within the confines thereof; and open rod receiving indentations in the brackets of the first pair.

3. The handlebar latching mechanism as set out by claim 2 further comprising spring means for urging the elongated rod into the open rod receiving indentations when the first and second slotted brackets are mated together.

4. The handlebar latching mechanism as set out by claim 1 wherein the matching slots of said first pair of slotted brackets are formed as open slots facing rearwardly away from the associated implement and the matching slots of said second pair of slotted brackets are formed as open slots facing forwardly toward the associated implement.

5. The handlebar latching mechanism as set out by claim 1 wherein the pins on the first bracket pair project from their respective brackets in opposite directions to be slidably received within slots of the second bracket pair and wherein the pins on the second bracket pair project oppositely both relative to each other and individually with respect to the corresponding pins of the first bracket pair.

6. The handlebar latching mechanism as set out by claim 1 wherein the matching slots of said first pair of slotted brackets are formed as open slots facing rearwardly away from the associated implement and wherein the matching slots of said second pair of slotted brackets are formed as open slots facing forwardly toward the associated implement, the open slots of both bracket pairs being parallel along their lengths.

7. The handlebar latching mechanism as set out in claim 6 wherein the detent means comprises:

a matching pair of closed slots in the second pair of brackets; said closed slots being substantially perpendicular to the remaining bracket slots of the first and second bracket pairs;

an elongated rod extending between the brackets of the second pair and being received within the matching pair of closed slots for movement within the confines thereof; and open rod receiving indentations in the brackets of the first pair.

8. The handlebar latching mechanism as set out by claim 6 wherein the pins of the first bracket pair are spaced forwardly toward the associated implement in relation to the open slots of the first bracket pair and the pins of the second bracket pair are spaced rearwardly away from the associated implement in relation to the open slots of the second bracket pair.

9. The handlebar latching mechanism as set out in claim 8 wherein the detent means comprises:

a matching pair of closed slots in the second pair of brackets; said closed slots being substantially perpendicular to the remaining bracket slots of the first and second bracket pairs;

an elongated rod extending between the brackets of the second pair and being received within the matching pair of closed slots for movement within the confines thereof; and open rod receiving indentations in the brackets of the first pair.

10. The handlebar latching mechanism as set out by claim 9 further comprising spring means for urging the elongated rod into the open rod receiving indentations when the first and second slotted brackets are mated together.

* * * * *